US006050206A

United States Patent [19]

Wacker

[11] Patent Number: 6,050,206

[45] Date of Patent: Apr. 18, 2000

[54] SEWING MACHINE WITH AN ADJUSTABLE HEAD MODULE

[75] Inventor: Niklaus Wacker, Steckborn, Switzerland

[73] Assignee: Fritz Gegauf AG Bernina-Nahmaschinefabrik, Steckborn, Switzerland

[21] Appl. No.: 09/241,517

[22] Filed: Feb. 1, 1999

[30] Foreign Application Priority Data

Feb. 27, 1998 [CH] Switzerland ..... 0469/98

[51] Int. Cl.[7] ..... D05B 73/02

[52] U.S. Cl. ..... 112/259

[58] Field of Search ..... 112/259, 221, 112/225, 226, 227, 157

[56] References Cited

U.S. PATENT DOCUMENTS

| | | | |
|---|---|---|---|
| 349,438 | 9/1886 | Looker | 112/259 |
| 769,039 | 8/1904 | Abercrombie | 112/221 |
| 2,561,643 | 7/1951 | Adler | 112/259 |
| 4,421,042 | 12/1983 | Killinger | 112/259 |
| 4,461,228 | 7/1984 | Yoneda | 112/259 |
| 4,590,875 | 5/1986 | Sanvito et al. | 112/168 |
| 4,858,548 | 8/1989 | Echeverria | 112/221 X |
| 4,967,677 | 11/1990 | Seiriki et al. | 112/221 X |

FOREIGN PATENT DOCUMENTS

| | | |
|---|---|---|
| 445594 | 6/1927 | Germany . |
| 921661 | 12/1954 | Germany . |
| 2421683 | 11/1974 | Germany . |
| 3703978 | 11/1987 | Germany . |

*Primary Examiner*—Ismael Izaguirre
*Attorney, Agent, or Firm*—Edwin D. Schindler

[57] ABSTRACT

A sewing machine having an adjustable head module, which has a machine body and a machine housing, along with a support plate for supporting a workpiece, and a support arm. Driving device for driving a looper in a looper system in the support plate, and for a needle bar in the adjustable head module at the end of the support arm is provided. The head module is pivotably mounted on the support arm, and pivotable, or swinging, about a horizontal pivot bearing in a first sewing direction and axially displaceable in a second sewing direction, in which the first and second sewing directions are perpendicular to one another. The head module can be adjusted on the body of the sewing machine in the sewing direction and transversely to the latter in a simple manner and locked into the exactly adjusted, and optimal, position.

15 Claims, 4 Drawing Sheets

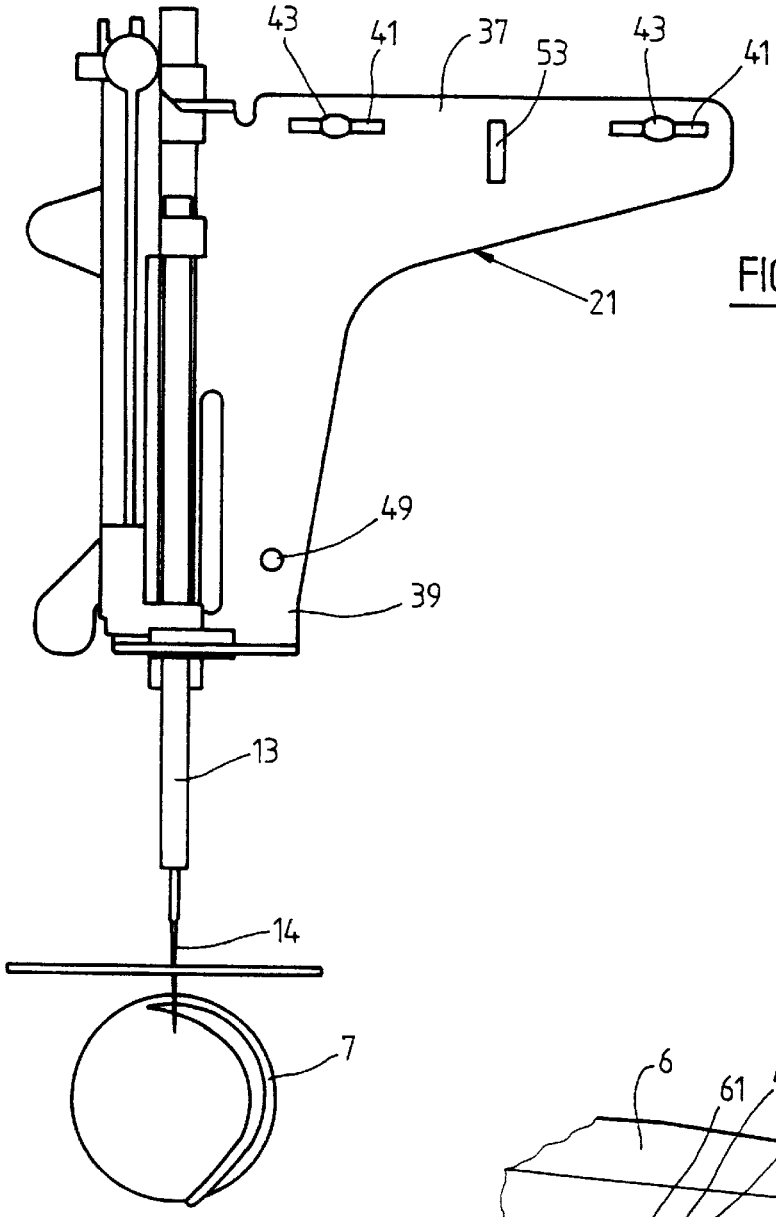
FIG. 3
FIG. 4
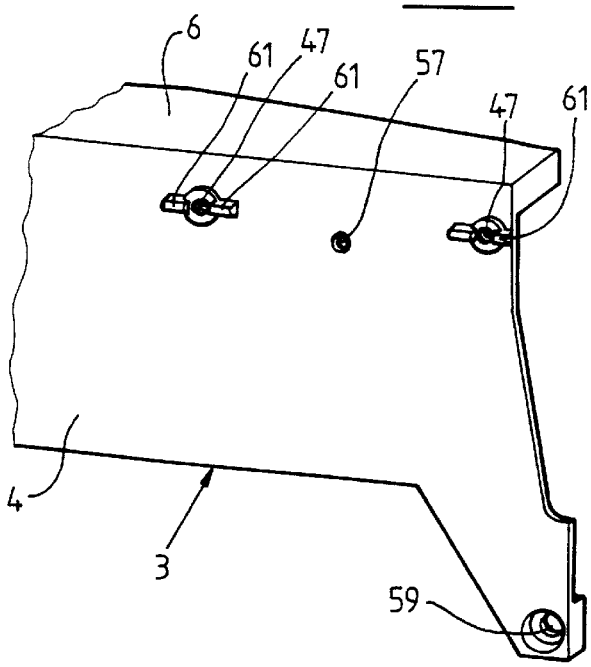

SEWING MACHINE WITH AN ADJUSTABLE HEAD MODULE

BACKGROUND OF THE INVENTION

1. Technical Field of the Invention

The present invention relates, generally, to a sewing machine with an adjustable head module.

More particularly, the present invention relates to a sewing machine with an adjustable head module, wherein the head module is pivotably mounted on a support arm and swings about a horizontal pivot bearing in a first sewing direction ("A"), and axially displaceable in a sewing second direction ("B.")

2. Description of the Prior Art

Sewing machines having a modular structure are currently known to the prior art. Such machines usually consist of various structural components, which are manufactured in different locations and subsequently assembled. The assembly of the various structural components generally requires costly adjustment work and, further, very precise execution of various points of connection between the individual structural components. Moreover, adjustment between a subassembly supporting the sewing machine needle and a subassembly receiving the looper is very difficult. Any adjustment of these two subassemblies, short of what would be consider optimal, may lead to incorrect stitching and needle fractures and, of course, less than perfect formation of the stitches.

A sewing machine with a modular structure is known to the art, for example, from Killinger, U.S. Pat. No. 4,421,042, issued Dec. 20, 1983. The sewing machine described in U.S. Pat. No. 4,421,042 includes a housing with a plate supporting a workpiece, and a supporting arm arranged above the plate supporting the workpiece. The plate supporting the workpiece receives the looper and the mechanism advancing the workpiece. The supporting arm accommodates the needle bar, the presser foot drive and a component for tensioning the thread. The driving motor, the driving shaft and the driving elements driving the needle bar, the presser foot bar, as well as the looper and the device transporting the material being sewn, are installed in the housing. The three subassemblies, discussed above, are connected by means of screws and, inasmuch as no adjusting means are present, the accuracy or precision in the manufacture of the elements, joining the three subassemblies, is expected to meet extremely high requirements.

A similar device is known from Sanvito et al., U.S. Pat. No. 4,590,875, issued May 27, 1986, in which a subassembly, with the needle bar drive and the fabric presser drive, and, below, a subassembly with the looper and the means for driving the material to be sewn, can be screwed to a housing on the supporting arm as well; said housing receiving the drives. The precision of the individual subassemblies has to satisfy extremely high requirements with this prior art apparatus, as well, because adjustment of the individual subassemblies is either not possible or possible, but to only a limited extent and, then, only with the expenditure of a substantial amount of time and effort.

SUMMARY OF THE INVENTION

It is, therefore, an object of the present invention to provide a sewing machine with an adjustable head module, which is able to be manufactured at a favorable cost and independently of the housing of the sewing machine.

It is a further object of the present invention to provide a sewing machine with an adjustable head module, which is easily adjustable with respect to the setup of the looper, after the housing of the sewing machine has been mounted.

It is yet a further object of the present invention to provide a sewing machine with an adjustable head module, which overcomes the disadvantages inherent in comparable sewing machines presently known to the prior art.

The foregoing and related objects are achieved by a sewing machine having an adjustable head module, which has a machine body and a machine housing, along with a support plate for supporting a workpiece, and a support arm. Driving means are provided for driving a looper in a looper system in the support plate, and for a needle bar in the adjustable head module at the end of the support arm. The head module is pivotably mounted on the support arm, and pivotable, or swingable, about a horizontal pivot bearing in a first sewing direction and axially displaceable in a second sewing direction, in which the first and second sewing directions are perpendicular to one another.

The head module, in accordance with the present invention, can be adjusted on the body of the sewing machine in the sewing direction, and transversely to the latter in a simple manner, and locked into the exactly adjusted, and optimal, position. Such adjustment permits an exact setting of the needle with respect to the looper, without making it necessary for the components of the sewing machine to be joined, or parts of the subassemblies to first have to be additionally worked on their contact surfaces, which include, for example, die castings. The components of the sewing machine, or subassemblies, can be assembled in the "raw" condition. The body of the machine, consequently, can be joined without after-working with the supporting plate of the head module; the supporting plate also comprising a punched bending component not subjected to any after-treatment.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views:

FIG. 3 is a back view of the head module;

FIG. 4 is a partial view of the supporting arm without the head module; and, FIG. 5 is a sectional view through the supporting arm and the head module in the region of the pivot bearing and the adjusting device along line V—V of FIG. 1.

DETAILED DESCRIPTION OF THE DRAWING FIGURES AND PREFERRED EMBODIMENTS

Figure 1:
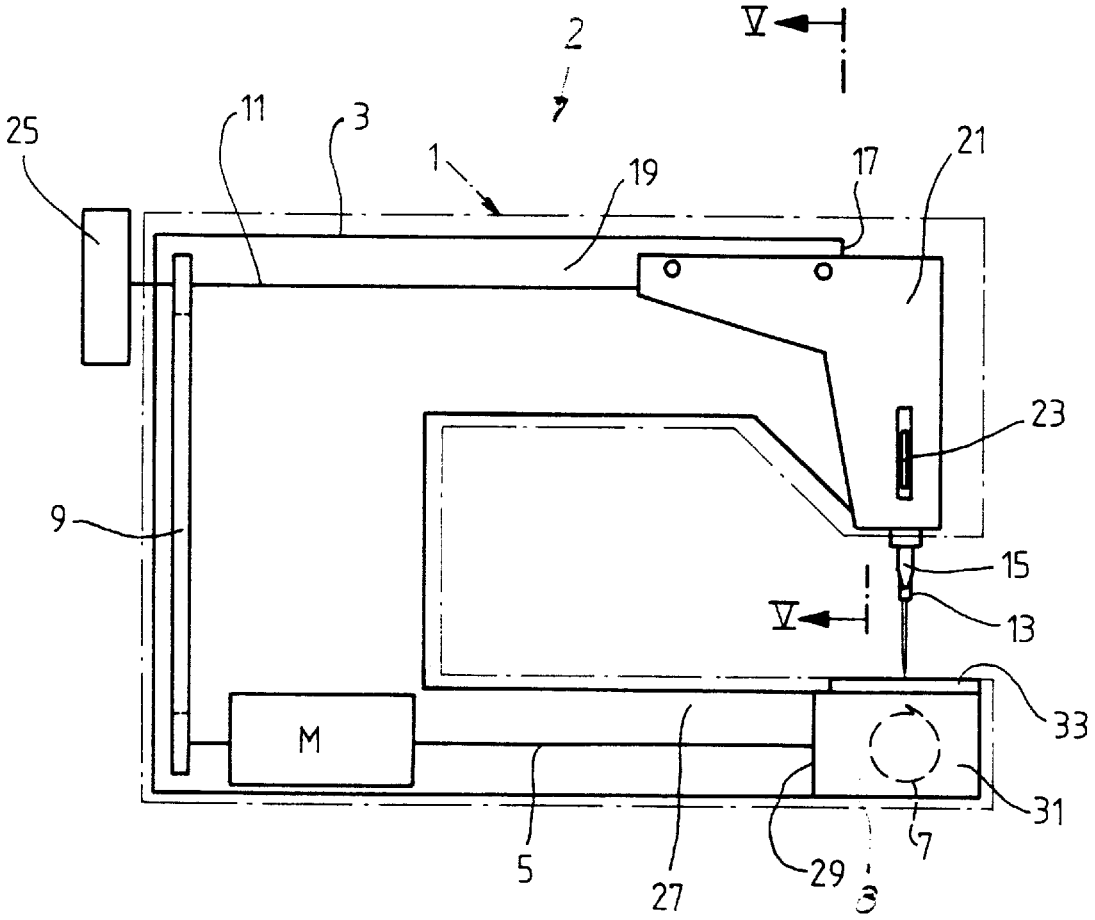
FIG. 1 is a schematic representation of a sewing machine with a head module attached thereto.

Turning now, in detail, to the accompanying drawing figures, in FIG. 1, reference numeral 1 denotes a machine housing of a sewing machine 2 by broken lines, said machine housing 1 at least partially enclosing machine body 3. Machine housing 1 may be manufactured from metal or plastic material. Machine body 3 is, preferably, produced from pressure die-cast and, in its interior, supports a driving motor "M" with driving means 5 for driving a looper 7 of looper system 8, as well as transmitting means 9, 11 for driving needle bar 13 with needle 14. The design of the driving means for needle bar 13 and looper system 7 is known from the state of the art and, consequently, said driving means are not described herein in greater detail, but shown only schematically.

A head module 21 is secured at the front face-side end 17 of a supporting arm 19 of sewing machine 2. The head module contains needle bar 13, a sewing foot bar 15, and its guides, as well as a lifting device for sewing foot bar 15 (only the levers 23 are visible.)

A handwheel 25, for manually moving needle bar 13, may be arranged opposite head module 21. A looper system module with stitch plate 33 is mounted on the front end 29 of a support plate 27 supporting the workpiece.

Figure 2:
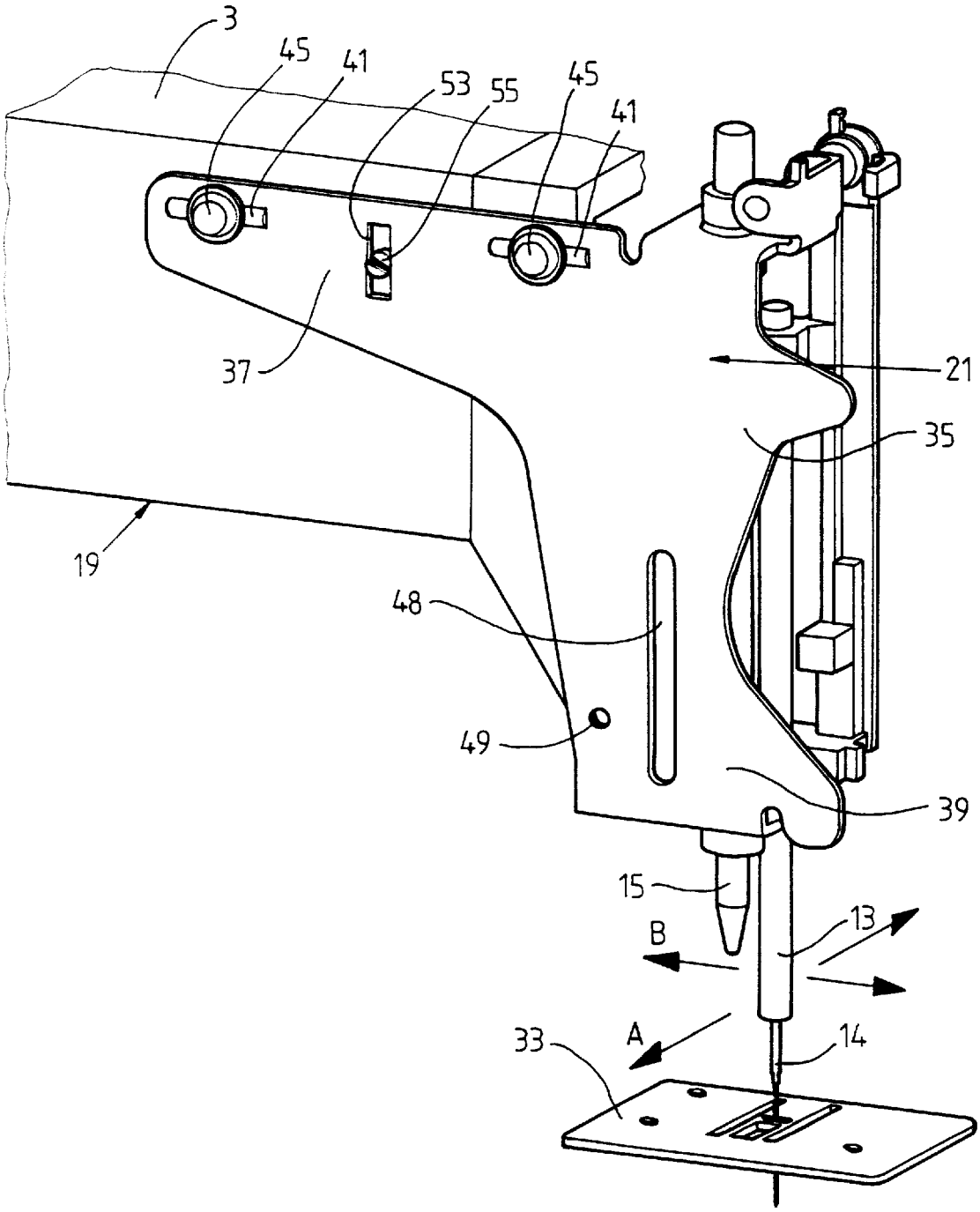
FIG. 2 shows a front end view of a supporting arm and the head module, according to FIG. 1, mounted on the supporting arm.
Figure 5:
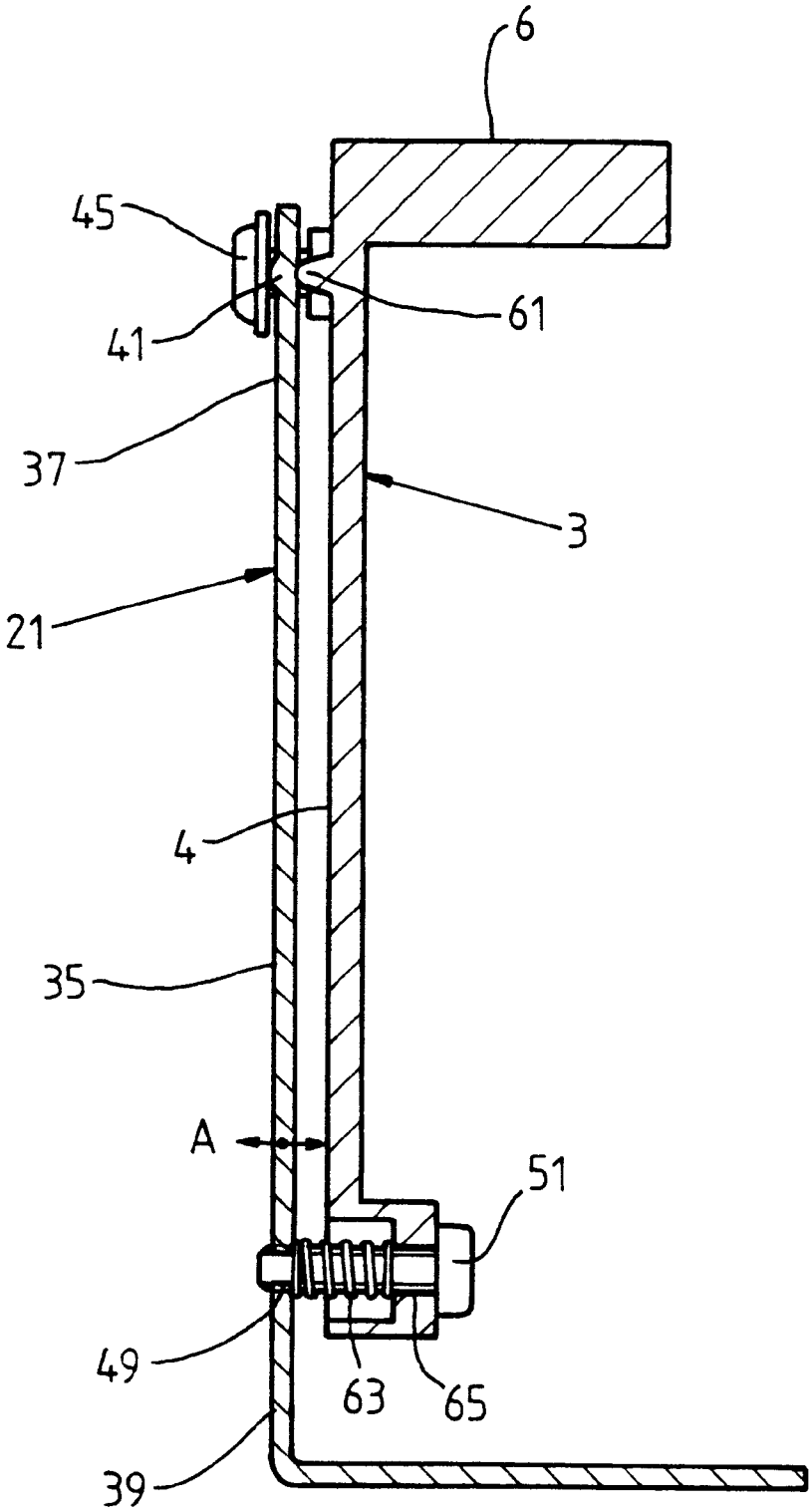

Head module 21, which is shown enlarged in FIGS. 2, 3 and 5, comprises an additional support plate 35, conceived as a punched/bending component, and which contains the recesses and bores required for guiding components of the machine and their mounting. Support plate 35 has a substantially L-shaped form with an upper horizontally extending first leg 37 and a vertically extending second leg 39. Two horizontally extending, outwardly directed reinforcing flanges 41 are formed on the horizontal first leg 37. An oblong hole 43 is provided in the central part of flange 41 dividing the flange 41 into two sections. A screw 45 can be screwed through said oblong hole into each of the threaded bores 47 on machine body 3. Another vertically extending recess 48 is punched in the vertical leg 39, through which presser foot lifting lever 23 can be guided. A threaded bore 49 is provided laterally of recess 48, into which an adjusting screw 51 can be turned; said screw being supported on machine body 3 in a bore 59.

Another vertically extending slot 53 may be provided in support plate 35 between the two pairs of flanges 41, said extending slot 53 being engaged by the head of an eccentric pin 55, rotatably supported in a bore 57 in machine body 3. By turning eccentric pin 55, it is possible to adjust head module 21 in the direction indicated by arrows "B."

On machine body 3, of which only front side 4 and part of covering surface 6 are visible in FIG. 4, provision is made for ribs 61 disposed laterally of the two threaded bores 47 for screws 45. Said ribs are intended for engaging the flanges 41 from behind when head module 21 is mounted on machine body 3.

In the front view of head module 21, as illustrated in FIG. 5, in which machine body 3 is visible, a cross-section is shown through one of the flanges 41; said flange being engaged from behind by the apex of rib 61. Support plate 35, consequently, abuts machine body 3 only on the apex of rib 61. The apex of rib 61, thus, forms a pivot-bearing about which head module 21 is pivotable by adjusting screws 51 in the direction of arrows "A." The mounting screws 45, first, keep support plate 35 fixed on ribs 61 with low support pressure. On the second leg 39 of support plate 35, adjusting screw 51 engages the threaded bore 49 on support plate 35. A spring 63, the one end of which abuts the back side of support plate 35, and the other end of which is supported on machine body 3, presses support plate 35 away from the machine body. Coil spring 63 is, preferably, mounted on the screw shaft of adjusting screw 51. So as to provide spring 63 axially with adequate space, machine body 3 may be provided with a recess 65 in the region of guide bore 59 for adjusting screw 51.

The following explains how head module 21 is mounted on support arm 19:

Support plate 35 is joined with support arm 19 with the two screws 45 without tightening the screws 45 immediately. At the same time, adjusting screw 51 is turned into threaded bore 49 on support plate 35. Head module 21 is now adjusted with eccentric screw 55, transversely to the sewing direction (arrows "B") and, subsequently, with adjusting screw 51 in the sewing direction (arrows "A.") As soon as the position of the head module 21, or needle 14, with respect to looper system 8 has been exactly fixed, the two mounting screws 45 are tightened. Head module 21, or needle 14, can be adjusted in this manner with an accuracy of hundreds-of-a-millimeter.

While only several embodiments of the present invention have been shown and described, it will be obvious to those skilled in the art that many modifications may be made to the present invention without departing from the spirit and scope thereof.

What is claimed is:

1. A sewing machine having an adjustable head module, comprising:

a needle bar having a needle;

a support arm;

a support plate for supporting a workpiece, and said support arm;

a head module being pivotally mounted on said support arm, pivotal about a horizontal pivot bearing in a first sewing direction and axially displaceable in a second sewing direction;

a looper in a looper system; and, means for driving said looper in said looper system in said support plate, and for said needle bar in said head module at an end of said support arm.

2. The sewing machine having an adjustable head module according to claim 1, wherein said first sewing direction and said second sewing direction are perpendicular relative to one another.

3. The sewing machine having an adjustable head module according to claim 1, wherein the horizontal pivot bearing is formed in said head module by at least one rib formed on a surface of said support arm, and by at least one flange extending substantially horizontally therefrom.

4. The sewing machine having an adjustable head module according to claim 3, wherein said head module includes an additional support plate on which at least one flange is formed.

5. The sewing machine having an adjustable head module according to claim 4, wherein said at least one flange includes at least one slot-like recesses therein for inserting set-screws.

6. The sewing machine having an adjustable head module according to claim 4, wherein a plurality of said flanges is provided and includes slot-like recesses, for inserting set-screws, between said plurality of flanges.

7. The sewing machine having an adjustable head module according to claim 3, wherein said support arm has threaded bores therein for guiding set-screws, the threaded bores being provided in said support arm laterally of said at least one rib.

8. The sewing machine having an adjustable head module according to claim 3, wherein said support arm has threaded bores therein for guiding set-screws, the threaded bores being provided in said support arm between a plurality of said ribs.

9. The sewing machine having an adjustable head module according to claim 1, further comprising means for pivoting said head module about the horizontal pivot bearing, said means for pivoting being spaced from at least one flange in said head module.

10. The sewing machine having an adjustable head module according to claim 9, wherein said means for pivoting said head module includes said support plate having a threaded bore therein, into which said threaded bore an adjusting screw, guided in a bore in said support arm, is turnable.

11. The sewing machine having an adjustable head module according to claim 10, further comprising a pressure spring clamped between said support arm and said support plate.

12. The sewing machine having an adjustable head module according to claim 1, further comprising means for axially displacing said head module in a horizontal direction, said means for axially displacing being provided on said support arm.

13. The sewing machine having an adjustable head module according to claim 12, wherein said means for axially displacing includes an eccentric pin supported in said support arm and engaging a vertical slot on said head module.

14. The sewing machine having an adjustable head module according to claim 1, further comprising means for axially displacing said head module in a horizontal direction, said means for axially displacing being provided on said head module.

15. The sewing machine having an adjustable head module according to claim 14, wherein said means for axially displacing includes an eccentric pin supported in said support arm and engaging a vertical slot on said head module.

* * * * *